US005779315A

United States Patent [19]

Shultz

[11] Patent Number: 5,779,315

[45] Date of Patent: Jul. 14, 1998

[54] SUPPORT AID FOR USE DURING A BAPTISMAL CEREMONY

[76] Inventor: Cormey Shultz, 802 Old Lake City Hwy., Lake City, Tenn. 37769

[21] Appl. No.: 770,054

[22] Filed: Dec. 19, 1996

[51] Int. Cl.[6] ..... A47C 5/12

[52] U.S. Cl. ..... 297/423.1; 297/217.1; 297/451.13; 4/496

[58] Field of Search ..... 297/423.1, 451.13, 297/217.1, 452.63; 4/496, 578.1, 579; 482/140, 142, 145

[56] References Cited

U.S. PATENT DOCUMENTS

| | | | |
|---|---|---|---|
| D. 258,372 | 2/1981 | Pearo | 482/142 X |
| 1,456,317 | 5/1923 | Lauer | 482/140 |
| 2,362,111 | 11/1944 | Burns | 482/140 |
| 3,632,170 | 1/1972 | Witt | 297/452.63 |
| 4,613,187 | 9/1986 | Gordon | 297/195.1 X |
| 5,190,513 | 3/1993 | Habing et al. | 482/142 X |
| 5,342,265 | 8/1994 | Creelman et al. | 482/130 X |
| 5,518,487 | 5/1996 | Hallmark | 482/140 |

*Primary Examiner*—Peter R. Brown
*Attorney, Agent, or Firm*—Michael E. McKee

[57] ABSTRACT

A support aid for use during a baptismal ceremony involving the total immersion of an individual within a pool of water includes a base positionable within the pool of water and a backless seat upon which the individual remains seated during the baptism process. A feet-engaging cross-bar member is attached to the base so that as the individual remains seated upon the seat, the individual's feet are hooked beneath the cross-bar member, and a grip section associated with the base provides a hand grip to which the individual may hold. As the individual leans rearwardly until his head and torso are totally immersed beneath the surface of the water and subsequently returns to an upright, seated orientation during the baptism process, the individual maintains his feet beneath the cross-bar and holds onto the hand grip in order to stabilize and support himself. The support aid also reduces the effort required to be expended by a party, such as a minister, who performs the baptismal process.

7 Claims, 2 Drawing Sheets

SUPPORT AID FOR USE DURING A BAPTISMAL CEREMONY

BACKGROUND OF THE INVENTION

This invention relates generally to a baptismal ceremony involving total immersion in a pool of water and relates, more particularly, to the means and methods by which an individual is supported during the baptismal process.

Commonly, a baptismal ceremony involves two individuals—one of whom is the individual to be baptized and the other of whom is the party who performs or assists in the baptismal process. At the outset of the process, both the individual to be baptized and the party who performs the baptism stand together in a pool of water. The individual to be baptized is then lowered from the standing position to a lowermost position at which he is completely covered by the water. As the individual is lowered into the water, he typically leans over backwards (while bending his legs slightly at the knees) and permits himself to be lowered into the water by the party performing the baptism as that party supports much of the weight of the individual being baptized. After reaching the aforedescribed lowermost position, the individual is returned to a standing position.

It will be appreciated that as the individual being baptized is leaned backwardly into the water to the aforedescribed lowermost position and subsequently returned to a standing position, the individual is incapable of maintaining control over his own balance. In other words, soon after the individual is leaned rearwardly from his standing position, he typically loses his balance. Consequently, during the course of the baptismal act, the support and stability of the individual being baptized is dependent almost entirely upon the party performing the baptism. Therefore, if the party who performs the baptism is not very strong or the individual being baptized is relatively large, the baptismal act can be difficult to perform, somewhat awkward in appearance, and cause anxiety in the individual to be baptized. It will also be appreciated that since the individual typically looses his balance as he is leaned rearwardly, there is a risk of physical injury to the individual during the baptismal ceremony.

It is an object of the present invention to provide a new and improved means for use during a baptismal ceremony which assists in the support of an individual as the individual is being baptized.

Another object of the present invention is to provide such means which enables the individual being baptized to stabilize himself throughout the baptismal process and thereby reduce the risk of physical injury to the individual during the process.

Still another object of the present invention is to provide such means which supports much of the weight of an individual during a baptismal process thereby enabling a party who is not very strong to perform or assist in a baptism ceremony involving an individual who is relatively large.

A further object of the present invention is to provide such means which is relatively uncomplicated in structure, yet effective in operation.

SUMMARY OF THE INVENTION

This invention resides in a support aid for use during a baptismal process to be performed upon an individual in pool of water.

The support aid includes a base positionable in a pool of water and means attached to the base providing a seat for an individual to be baptized. The seat is disposed relative to the base so that when the base is positioned within the pool of water and the individual is seated thereon, a portion of the individual's torso is disposed beneath the surface of the water of the pool. The support aid also includes feet-engaging means attached to the base against which the feet of the individual are positionable so that when the individual is seated upon the seat and feet are operatively positioned against the feet-engaging means, the cooperation between the feet-engaging means and the feet enable the individual to stabilize himself when he leans rearwardly into the water of the pool during the baptismal process.

In a particular aspect of the invention, the support aid includes grip means capable of being grasped by a hand of the individual being baptized so that as the individual leans rearwardly into the water during the baptism process, the individual stabilizes himself by way of his hand, as well as his feet.

DETAILED DESCRIPTION OF THE ILLUSTRATED EMBODIMENT

Figure 1:
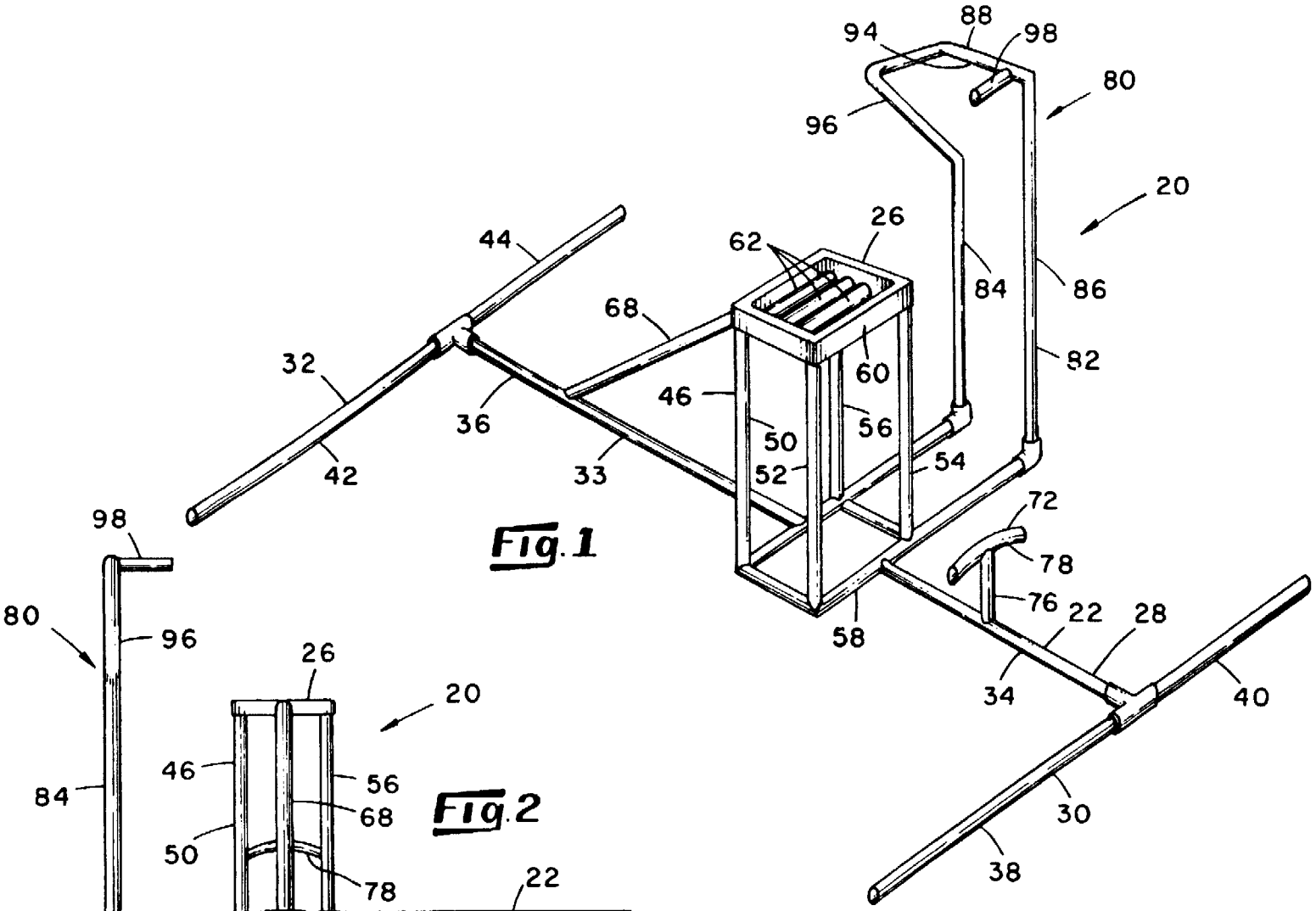
FIG. 1 is a perspective view of an embodiment of a baptismal support aid within which features of the present invention are embodied.

Turning now to the drawings in greater detail, there is shown in FIG. 1 an embodiment, generally indicated 20, of a support aid for use during a baptismal ceremony. The support aid 20 includes a base 22 which is positionable in a stationary condition in a baptistery comprising a pool 24 (FIGS. 3 and 4) of water and means attached to the base 22 for providing a backless seat 26 for the aid 20. During the use of the support aid 20, an individual to be baptized is seated upon the seat 26 and then leans rearwardly into the water of the pool before returning to an upright position upon the seat 26. As will be apparent herein, the support aid 20 is advantageous in that throughout the baptismal process, a substantial portion of the weight of the individual being baptized is supported by the aid 20 (by way of the seat 26). Consequently, a party who performs the baptismal process and who would otherwise be expected to support almost the entire weight of the individual during the process is relieved of much of the individual's weight by the aid 20, thereby rendering the baptismal act easier to perform.

The class of baptistery with which this invention is concerned includes those which resemble a pool within which a substantial amount of water is contained and typically are installed within church buildings. Moreover, such church baptisteries include a bottom of substantially flat configuration. Accordingly, the embodiment 20 described herein is provided with a base 22 which is adapted to rest upon the flat bottom of a pool of water. Preferably, the support aid 20 is positioned within such a baptistery as a permanent fixture therein, and the pipe-like construction (described herein) of the aid 20 does not inhibit or prevent the flow of water into or out of the baptistery in the event that the baptistery is required to be drained, refilled or cleaned. However, the aid 20 may be constructed as a relatively lightweight structure which can be removed or replaced within a baptistery as desired.

Another advantage of using the support aid 20 within a church baptistery relates to the clarity of and the consistency of the depth of the water contained within the pool. For example and as will be described herein, since the design of the support aid 20 is intended to support an individual seated upon its seat 26 so that much of his torso is disposed beneath the surface of the water, the design of the aid 20 takes into account the depth of the pool of water within which it is to be used. Moreover, since an individual who employs the support aid 20 must mount the seat 26 for use of the aid 20, it is also preferred that the support aid 20 be used in a pool of water which is clear enough to enable the individual to see the pipes (of the pipe-like construction) and the seat 26 of the aid 20. Accordingly, the using of the aid 20 within a church baptistery is more desirable than the using of the aid 20 within other pools of water, such as creeks or ponds, wherein the depth of the water is commonly neither controllable nor consistent and wherein the water contained within the pool is usually not very clear. It will be understood, however, that the principles of the present invention can be variously applied.

Figure 2:
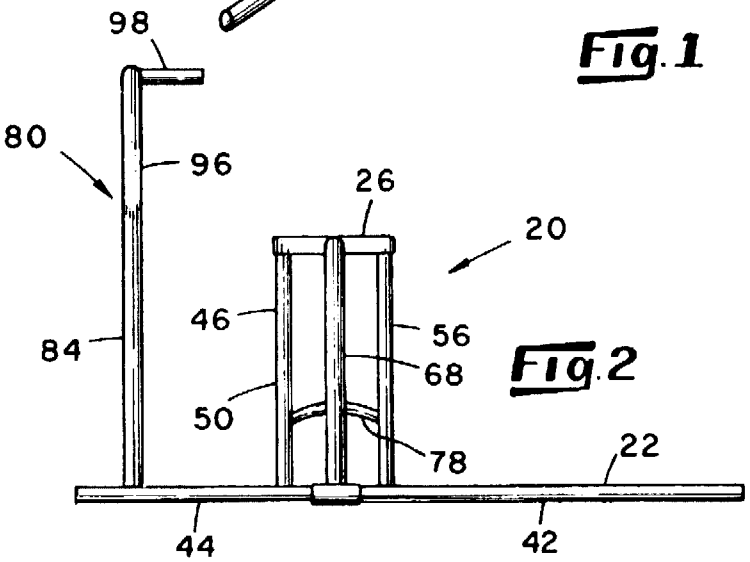
FIG. 2 is an end elevational view of the FIG. 1 embodiment, as seen generally from the left in FIG. 1.

With reference still to FIGS. 1 and 2, the base 22 of the depicted embodiment 20 is in the form of an elongated frame 28 having two opposite forward and rearward ends 30 and 32, respectively, and wherein the frame 28 is comprised of a plurality of tubular members. In particular, such tubular members include a bottom portion comprised of a substantially planar arrangement 33 of pipes 34, 36, 38, 40, 42 and 44 which are joined together in somewhat of an H-shape wherein the pipes 38 and 40 comprise one leg of the H-shape, the pipes 42 and 44 are joined together to form the other leg of the H-shape, and the two legs of the H-shape are joined by way of pipes 34 and 36 which are, in turn, arranged in an aligned relationship. Preferably, the ends of the pipes are appropriately capped to prevent the ingress of water therein.

The frame 28 of the base 22 also includes a pedestal-like seat-support portion 46 comprised of an arrangement 48 of pipes 50, 52, 54 and 56 which are attached together and maintained in a parallel relationship by way of a substantially square arrangement 58 of pipes joined to one end, i.e. the lower end as viewed in FIGS. 1 and 2, of the pipes 50, 52, 54 and 56, and the substantially square outer frame 60 of the seat 26. The square pipe arrangement 58 is joined to the H-shaped arrangement 33 of the frame 28 at a location disposed about midway between the opposing ends 30 and 32 of the frame 28 (as best shown in FIG. 1) so that the two legs of the H-shape of the frame 28 are joined by way of the pipe arrangement 58.

Each pipe of the frame 28 may be comprised of steel tubing (e.g. square in cross section) or some other suitable material, such as aluminum. Although not as strong as steel tubing, polyvinyl chloride (PVC) pipes can be used in the construction of the aid 20. The pipes (or tubing) of the frame 28 may be joined by way of Tee-fittings which can be appropriately either glued, threaded or welded together. The pipes of the frame 28 are sized to provide stability to the seat 26 during the course of a baptismal process.

The seat 26 of the depicted embodiment 20 includes the outer frame 60, introduced above, and a series of pipes 62 which span the interior of the frame 60 and are attached to opposite sides of the frame 60. The pipes 62 are maintained in a spaced and parallel relationship by the frame 60 to permit the flow of water therethrough. Such a feature can be appreciated in that if the support aid 20 is removed from a pool of water within which the aid 20 is positioned, the spaced relationship of the pipes 62 of the depicted seat 26 prevent the collection of water on the seat 26 and thereby facilitates the removal of the aid 20 from the water. If, however, it is desired that the comfort of the seat 26 is enhanced, then the upper surface of the seat 26 may be appropriately padded or covered with a relatively soft material.

Figure 3:
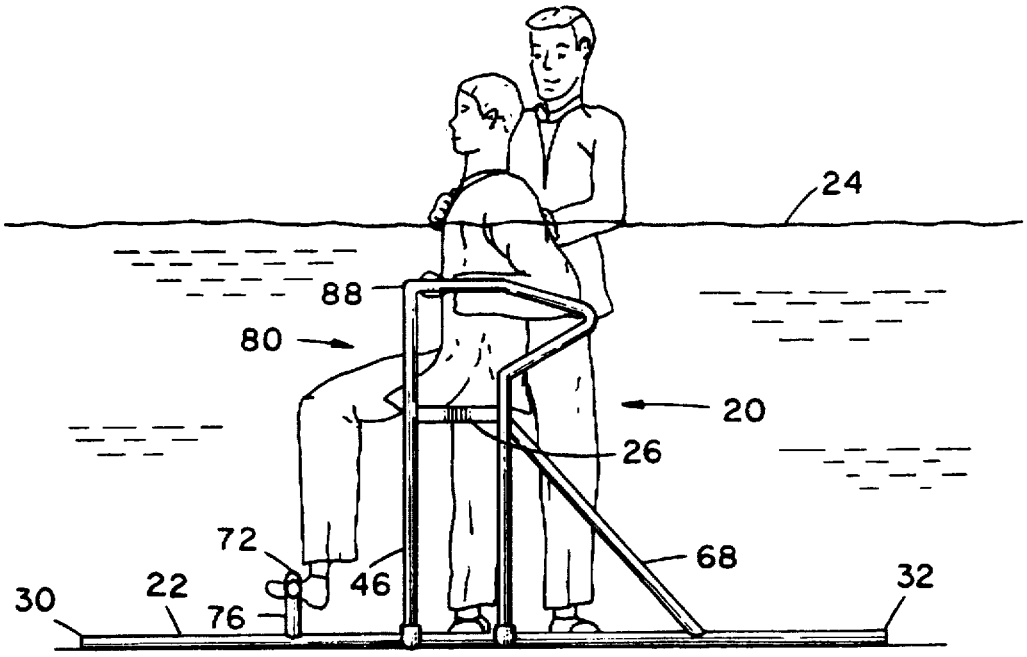
FIGS. 3 and 4 are front elevational views of the FIG. 1 embodiment shown being use during a baptismal ceremony.

As best shown in FIG. 3, the seat 26 is supported by the base 22 in an elevated position above the bottom of the pool 24 so that at least a portion of the torso of an individual who is seated upright upon the seat 26 is disposed beneath the surface of the water, leaving the head of the individual disposed above the surface of the water. Preferably, the seat 26 is disposed beneath the water so that when the individual is seated upon the seat 26, the surface of the pool is about even with the individual's chest.

To further stabilize and firmly fix the position of the seat 26 relative to the base 22, an additional pipe 68 is joined between the outer frame 60 of the seat 26 and the frame pipe 36 for acting as a brace therebetween.

With reference again to FIGS. 1 and 2, it is a feature of the support aid 20 that it includes means, generally indicated 70, enabling an individual who is seated upon the seat 26 to stabilize himself during the baptismal process. In the depicted embodiment 20, the enabling means 70 includes a feet-engaging portion 72 attached to the pipe 34 of the frame 28 and positioned adjacent the front of the seat 26, i.e. generally between the forward end 30 and the seat 26. The feet-engaging portion 72 includes an upstanding bar 76 and a cross-bar member 78 fixedly attached to the upstanding bar 76 to form somewhat of a T-shaped arrangement as best shown in FIG. 1.

As is explained herein, the individual who is seated upon the seat 26 hooks his feet beneath the cross-bar member 78 to help stabilize himself as he leans rearwardly from an upright orientation during a baptismal process. To prevent the feet from slipping from the side of the cross-bar member 78, the cross-bar member 78 is arcuate in shape and arranged upon the upstanding bar 76 so that the opposite (free) ends of the bar member 78 are lower than the mid-portion thereof. As is the case with the aforedescribed pipes of the frame 28 of the base 22, the upstanding bar 76 and the cross-bar portion 78 may be constructed of steel, aluminum or some other suitable material. If desired, the surface of the bar portion 78 may be covered with padding or some other soft material to enhance the comfort of the individual's feet when the feet are pressed against the underside of the bar member 78.

With reference still to FIGS. 1 and 2, the enabling means 70 also includes grip means 80 capable of being grasped and held by the individual seated upon the seat 26 throughout the baptismal process. In the depicted embodiment 20, the grip means 80 includes an arrangement 82 of pipes, described herein, which are fixedly joined to the base 22 and extends generally upwardly therefrom to provide the individual seated upon the seat 26 with something to grip, i.e. hold onto, during the baptismal act. More specifically, the pipe arrangement 82 includes a pair of parallel pipe sections 84, 86 which are joined to the square arrangement 58 of the frame 22 so as to extend to one side of the seat support section 46 and an elevated pipe section 88 joined intermediate of the pipe sections 84 and 86.

The elevated pipe section 88 is shaped, i.e. bent, between its ends 90, 92 to provide regions therealong which are disposed generally above and to one side of the seat 26. Such regions include a straight, substantially horizontally-disposed section 94 and a somewhat V-shaped section 96 joined to the horizontally-disposed section 96 so that the apex of the V of the section 96 is directed generally rearwardly relative to the seat 28. Each of section 94 or 96 is capable of being grasped by an individual during a baptismal ceremony. In addition, a bar section 98 is attached to one end of the horizontally-disposed section 94 so as to extend at right angle relative thereto. This bar section 98 provides an individual seated upon the seat with an alternative grip to which he may hold.

Figure 4:
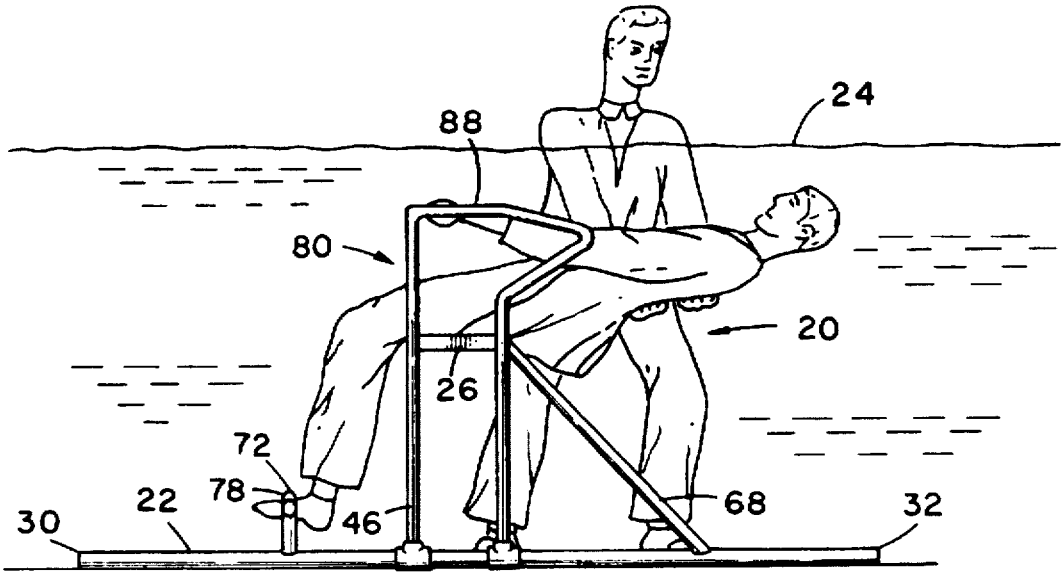

To use the support aid 20 and with reference to FIGS. 3 and 4, an individual who is desired to be baptized is seated upon the seat 28 so as to face forwardly of the seat 28, i.e. toward the left as viewed in FIG. 3. The individual then hooks his feet beneath the cross-bar member 78 of the feet-engaging portion 72 and grasps the bar section 98 (or a section 94 or 96 of the elongated grip section 88) with one of his hands, e.g. his left hand. A party, such as a minister, who performs or assists during the baptismal ceremony stands to one side of the seated individual opposite the side of the grip means 80 as shown in FIG. 3. During the baptism process, the seated individual leans rearwardly into the water from the position illustrated in FIG. 3 to the submerged position illustrated in FIG. 4 while he maintains his feet beneath the cross-bar member 78 and holds onto the bar section 98. After reaching the FIG. 4 position at which the individual is totally submerged beneath the water, the individual then returns to an upright, seated orientation as depicted in FIG. 3. Commonly, the party who performs the baptismal ceremony places at least one of his hands behind the back of the individual being baptized to steady the individual as he is lowered into and then raised from the water.

The advantages provided by the support aid 20 can be appreciated by both the individual being baptized and the party, such as a minister, who performs or assists in the baptism process. On one hand, the aid 20 permits the individual being baptized to use his legs to stabilize and steady himself and thereby maintain some control over the position of his body as he leans rearwardly into the water and subsequently returns to an upright orientation. To this end, the individual maintains his feet in a hooked relationship beneath the cross-bar member 78 and exerts an upwardly-directed force against the underside of the cross-bar member 78 as he leans rearwardly and subsequently returns to an upright, seated orientation. Consequently, the movements of the individual's torso during the baptism process simulate those involved in a sit-up type of exercise routine while his feet remain anchored beneath the cross-bar member 78.

Furthermore, the capacity of the individual to hold onto the bar section 98 enables the muscles of the corresponding one of the individual's arms to aid during the baptismal process. In other words, as the individual leans rearwardly, the arm with which the grip portion 100 is held is extended by the individual and helps to maintain the lean of the individual's torso in the desired, i.e. rearward, direction and regulates the speed with which the torso is leaned rearwardly. Moreover, as the individual returns from the FIG. 4 submerged position to the FIG. 3 upright position, the muscles of the arm contract and thereby help to pull the torso forwardly. Of course, throughout the baptism process, a substantial portion of the weight of the individual is supported upon the seat 28, and as the individual returns to an upright orientation of FIG. 3, the muscles of the individual's arm bear much of the weight of the individual's torso.

Since the individual being baptized may pull himself to the FIG. 4 upright orientation by way of his arm and leg muscles, the party who performs the baptism process need not support as much of the individual's weight as he would if the individual being baptized begins his rearward lean from a standing position and must be returned to a standing position. Thus, the support aid 20 reduces the effort which would otherwise be required to be expended by the party performing the baptism process. It follows that the support aid enables a party who is not particularly strong to perform a baptism upon an individual who may be quite large.

It follows from the foregoing that a support aid 20 has been described which facilitates a baptism process. More particularly, a support aid 20 has been described which enables an individual being baptized to stabilize and support himself throughout the baptism process and reduces the effort which would otherwise be expended by a party who performs or assists in the baptism process. Because the individual being baptized is able to stabilize himself by way of the feet-engaging portion 72 and the grip means 80, the likelihood that the individual being baptized will experience anxiety regarding the capacity of the party who performs the baptism to adequately support the individual is reduced.

By way of example, dimensions for a support aid 20 found to be suitable for use in a baptistery having a pool of water having a depth of about 34.0 inches are provided here as follows. The overall length of the support aid 20 (as measured end-to-end) is about 86.0 inches; the distance from the front end 30 of the base 22 to the seat support section 46 is about 26.0 inches; the distance from the front end 30 of the base 22 to the feet-engaging portion 72 is about 5.0 inches; the height of the feet-engaging portion 72 is about 12.0 inches; the length of the cross-bar member 78 is about 14.0 inches; the length of each end of the frame 22 (i.e. the summation of the length of the pipes 38 and 40 or 42 and 44) is about 47.0 inches (to accommodate the positioning of the aid 20 within a baptistery having a width of about 48.0 inches); and each side of the seat 26 is about 14.0 inches in length. Furthermore, the pipes of the aid 20 can be comprised of steel tubing (e.g. of fourteen gauge steel) which measures 1.25 inches along each side.

It will be understood that numerous modifications and substitutions can be had to the aforedescribed embodiment without departing from the spirit of the invention. For example, although the support aid 20 has been described herein as being comprised primarily of pipes which are commonly hollow, the tubular construction of a support aid in accordance with the broader aspects of the present invention can employ pipes which have solid interiors. Still further, although the support aid 20 has been shown and described above as a "left-handed version" which enables the individual seated upon the seat 26 to grasp the grip means 80 with his left hand and requires the party who assists in the baptism to stand to the right of the individual, an aid can be constructed (e.g. as a mirror image to the aid 20) as a "right-handed version" which enables the individual seated upon the seat to grasp the grip means thereof with his right hand and requires the party who assists in the baptism to stand to the left of the individual. Accordingly, the aforedescribed embodiment is intended for the purpose of illustration and not as limitation.

I claim:

1. A support aid for use during a baptismal process to be performed upon an individual within a pool of water wherein the individual leans rearwardly from an upright orientation to a totally-immersed position within the pool of water during the baptismal process, the support aid comprising:

a base positionable in a pool of water and in a stationary condition with respect to the bottom of the pool;

means attached to the base providing a backless seat upon which an individual is seated for the baptismal process, wherein the seat is disposed relative to the base so that when the base is positioned within the pool of water for use of the support aid, a portion of the individual's torso is disposed beneath the surface of the water in the pool;

feet-engaging means attached to the base including a rigid member beneath which the feet of the individual are positionable so that when the individual is seated upon the seat and his feet are positioned beneath the rigid member of the feet-engaging means, the individual is able to stabilize himself during the baptismal process by urging his feet upwardly against the rigid member of the feet-engaging means; and grip means attached to the base and including a hand grip disposed to one side of the seat so that when the individual is seated upon the seat, the hand grip is capable of being grasped and held by the individual during the baptismal process; and wherein each of the base, seat and grip means are of constructed of pipe members joined together to form the support aid;

the base includes an elongated lower portion having forward and rearward ends for engaging the bottom of the pool within which the support aid is positionable and a pedestal portion upon which the seat is supported for elevating the seat above the lower portion of the base so that when an individual is seated upon the seat, his feet depend generally downwardly therefrom; and the rigid member of the feet-engaging means is disposed generally between the seat and the forward end of the lower portion of the base and at an elevation between that of the seat and the lower portion so that when an individual is seated upon the seat with his feet depending downwardly therefrom, the feet can be moved as the individual pivots his legs at the knees between a raised position at which his feet engage the underside of the rigid member for urging thereagainst during the baptismal process and a lowered position which facilitates the movement of the individual to a standing position; and wherein the member of the feet-engaging means is in the form of a cross-bar member which extends transversely of the support aid and has two opposite ends and a mid-portion, and the cross-bar is shaped so that the ends of the cross-member are lower than the mid-portion thereof.

2. The support aid as defined in claim 1 wherein the grip means includes at least one pipe which extends generally upwardly from the base, and the hand grip is joined to the at least one pipe at a location disposed to one side of the seat.

3. A support aid for use during a baptismal process to be performed upon an individual in a pool of water, the support aid comprising:

a base positionable in a pool of water;

means attached to the base providing a seat for an individual to be baptized, the seat being disposed relative to the base so that when the base is positioned within the pool of water and the individual is seated thereon, a portion of the individual's torso is disposed beneath the surface of the water of the pool; and feet-engaging means attached to the base and including a member beneath which the feet of the individual is positionable so that when the individual is seated upon the seat and feet are operatively positioned beneath the member of the feet-engaging means, the individual is able to stabilize himself when he leans rearwardly into the water of the pool during the baptismal process by urging his feet upwardly against the member of the feet-engaging means; and wherein the member of the feet-engaging means is in the form of a cross-bar member having two joined arms which extend transversely of the support aid and a mid-portion disposed between the two arms, and the support aid includes a leg section which is joined to the cross-bar member by way of the mid-portion thereof.

4. The support aid as defined in claim 3 wherein the seat is of tubular construction to prevent the collection of water thereupon when the support aid is removed from the pool of water.

5. The support aid as defined in claim 3 further comprising grip means associated with the base having a hand grip capable of being grasped and held by the hand of the individual during the baptism process.

6. The support aid as defined in claim 5 wherein the each of the base of the frame, the seat and the hand grip is tubular in construction.

7. The support aid as defined in claim 5 wherein the hand grip is disposed to one side of the seat.

* * * * *